US005580299A

United States Patent [19]

Pomikacsek

[11] Patent Number: 5,580,299

[45] Date of Patent: Dec. 3, 1996

[54] PROCESS AND APPARATUS FOR MACHINING THE TOP SURFACE OF A RAIL BY CIRCUMFERENTIAL GRINDING

[76] Inventor: Josef Pomikacsek, Bahnhofstrasse 10, A-4813 Altmünster, Austria

[21] Appl. No.: 458,265

[22] Filed: Jun. 2, 1995

[30] Foreign Application Priority Data

Oct. 20, 1994 [DE] Germany ..... 44 37 585.9

[51] Int. Cl.[6] ..... B24B 1/00

[52] U.S. Cl. ..... 451/28; 451/347; 451/429; 125/11.03

[58] Field of Search ..... 451/347, 429, 451/142, 28, 424, 425; 125/11.03, 11.04

[56] References Cited

U.S. PATENT DOCUMENTS

| | | | |
|---|---|---|---|
| 1,169,377 | 1/1916 | Barnhart | 451/424 |
| 1,923,020 | 8/1933 | Fox | 451/347 |
| 2,018,411 | 10/1935 | Miller | 451/429 |
| 2,140,860 | 12/1938 | Steele | 451/425 |
| 3,214,868 | 11/1965 | Riley | 451/347 |
| 4,607,607 | 8/1986 | Janutta et al. | 125/11.03 |
| 4,658,800 | 4/1987 | Larson | 125/11.03 |
| 5,067,283 | 11/1991 | Pomikacsek | 451/347 |

FOREIGN PATENT DOCUMENTS

| | | |
|---|---|---|
| 640817 | 1/1937 | Germany . |
| 1098395 | 1/1961 | Germany . |
| 2551358 | 5/1976 | Germany . |
| 2118209 | 4/1982 | Germany . |
| WO88/02300 | 4/1988 | WIPO . |

OTHER PUBLICATIONS

Industrie–Anzeiger, 75th year, No. 48, Jun. 16, 1953 "Das Einrollen von Profilen in Schleifscheiben" pp. 587–589 (Published: W. Girardet, Essen, Germany).

*Primary Examiner*—Bruce M. Kisliuk
*Assistant Examiner*—Derris H. Banks
*Attorney, Agent, or Firm*—Collard & Roe, P.C.

[57] ABSTRACT

In the proposed process of machining the top surface of a rail by a circumferential grinding by means of at least one abrasive product, which is moved along the rail and urged against the top surface of the rail and rotates about an axis of rotation which includes an acute angle with the longitudinal direction of the rail, desirable grinding conditions are ensured in that a freely rotatable abrasive is caused to roll and slide on the top surface is caused to roll and slide on the top surface of the rail in frictional contact therewith and thus to grind said top surface.

8 Claims, 4 Drawing Sheets

PROCESS AND APPARATUS FOR MACHINING THE TOP SURFACE OF A RAIL BY CIRCUMFERENTIAL GRINDING

BACKGROUND OF THE INVENTION

1. Field of the Invention

This invention relates to a process of machining the top surface of a rail by a circumferential grinding by means of at least one abrasive product, which is moved along the rail and be urged against the top surface of the rail and rotates about an axis of rotation which includes an acute angle with the longitudinal direction of the rail. The invention relates also to an apparatus for carrying out the process.

2. Description of the Prior Art

From DE 21 18 209 C3 it is known that the top surfaces of rails for railborn vehicles can be machined by means of a plurality of grinding wheels, which are mounted in a grinding frame one behind the other in such a manner that their horizontal axes of rotation extend at an acute angle to the longitudinal direction of the rail. Said grinding wheels are driven by respective motors and by means of pressure-applying cylinders are forced against the top surfaces which are to be machined so that the top surfaces of the rail are ground by a circumferential grinding as the grinding frame is moved along the rails. Like all known rail-grinding processes that circumferential grinding by means of inclined grinding wheels has the disadvantage that the grinding conditions permit the grinding frame to be advanced along the rails only at a relatively low speed. Besides, the pressure under which the grinding wheels are forced against the rails must be controlled in dependence on the feed rate if material is to be removed at a uniform rate although the feed rates vary.

SUMMARY OF THE INVENTION

For this reason it is an object of the invention to eliminate these disadvantages and the provide for the circumferential grinding of the top surface of a rail a process which involves a low expenditure and permits a desirable removal of material even at relatively high feed rates whereas an overload need not be feared.

The object set forth is accomplished in accordance with the invention in that a freely rotatable abrasive product is employed and its peripheral surface is caused to roll and slide on the top surface of the rail in frictional contact therewith and thus to grind said top surface.

Because the abrasive product is freely rotatable, the expenditure is eliminated which is otherwise involved in means for driving the abrasive product. Nevertheless, because the axis of rotation of the abrasive product is inclined from the longitudinal direction of the rail, the abrasive product is rotated and slides on the top surface of the rail as it rolls on said surface in frictional contact therewith. This will ensure an adequate grinding motion between the abrasive product and the top surface of the rail. Because the velocity of that grinding motion will increase with the feed rate, optimum grinding conditions will be established only at relatively high feed rates. The grinding conditions established by the free rolling of the abrasive product on the top surface of the rail have the result that the projection on a plane which is parallel to the rail foot of the line of contact between the abrasive product and the profiled top surface of the rail is S-shaped and extends from one side of said top surface to the other and the axis of rotation of the abrasive product constitutes an inflectional tangent to said projection. In dependence on the angle of inclination of the abrasive product the top surface of the rail is contacted by the abrasive product in an area which extends along the rail and during a grinding of height deviations existing along a line which extends along the rail and consisting of ripples or short corrugations said area of contact will include more than one of said height deviations so that the otherwise arising risk of a copying of the corrugated height deviations can be substantially eliminated.

Because the grinding depth will depend on the pressure under which the abrasive product is forced against the top surface of the rail and the grinding motion is not imparted to the abrasive product by a separate motor but by the feeding of the abrasive product along the rail, the pressure applied by the abrasive product to the top surface of the rail may be constant regardless of the feed rate. For a grinding of a given top surface having a predetermined profile, a dressing tool may be used by which the abrasive product as it is frictionally rotated can be dressed during the grinding operation to have the shape required for the desired profile of the top surface of the rail. From that aspect very simple conditions will be established if a freely rotatable dressing member is forced against the abrasive product during the grinding of the top surface of the rail and the axes of rotation of the abrasive product and of the dressing member cross at an acute angle. Owing to that crossing at an acute angle, the abrasive product will impart to the dressing member a rotation, which is accompanied by a relative sliding movement of the contacting surfaces so that the desired dressing will be effected.

In the process in accordance with the invention for circumferentially grinding the top surface of a rail a grinding frame may be employed, which is movable along the rails in contact with the top surfaces of the rails and which is provided with at least one rotatably mounted abrasive product for a circumferential grinding, which abrasive product has an axis of rotation which includes an acute angle with the longitudinal direction of the rails. In that case the abrasive product is freely rotatably mounted in the grinding frame and in the direction in which pressure is applied by the abrasive product to the top surface of the rail is supported against the grinding frame by a spring member, which is adapted to be bridged by a rigid support. Such an arrangement will permit desirable grinding conditions to be established, which can be adapted to different conditions. Adjacent to the crests of height deviations in the longitudinal direction the additional resilient support of the abrasive product will result in an increase of the pressure applied in dependence on the spring characteristic of the spring so that there is a virtually automatic control of the pressure force which is applied by the abrasive product to the top surface of the rail in dependence on the height deviation. But because that ability of the abrasive product to yield to an increasing pressure force may not always be desirable, the spring member can selectively be bridged by a rigid support.

If a plurality of abrasive products are mounted in a common grinding frame, a particularly compact arrangement will be provided if the hub of each abrasive product is freely rotatably mounted on an axle which is held in a guiding yoke so that the guiding yoke may be very simple as there is no need for bearings in that yoke.

For dressing the abrasive product, a dressing member may be provided, which on that side of the abrasive product which faces away from the top surface of the rail is held in the guiding yoke for the abrasive product and in said yoke is radially displaceable with respect to said abrasive product and is adapted to be forced against the abrasive product. Although that dressing member might be stationary whereas the abrasive product is rotatable, more desirable conditions will be established if the dressing member is freely rotatably mounted in a bearing yoke, which is radially displaceable relative to the guiding yoke with respect to the abrasive product, and the axes of rotation of the abrasive product and of the dressing member cross at an acute angle. If the dressing member is forced against the abrasive product during the grinding operation, the abrasive product will impart a rotation to the dressing member. This will cause the abrasive product and the dressing member to roll and slide in contact with each other so that the abrasive product and the dressing member will perform in the region in which they contact each other the relative movement which is required for the dressing operation.

DETAILED DESCRIPTION OF THE PREFERRED EMBODIMENTS

Figure 1:
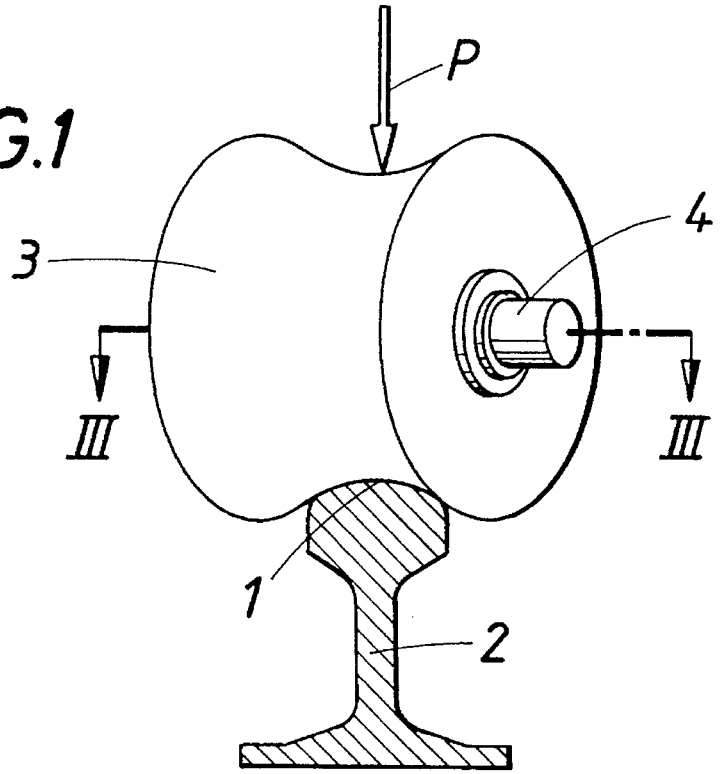
FIG. 1 is a schematic elevation showing an abrasive product used in accordance with the invention and viewed in the longitudinal direction of the rail.

The process in accordance with the invention will be described more in detail with reference to the drawing.

Figure 2:
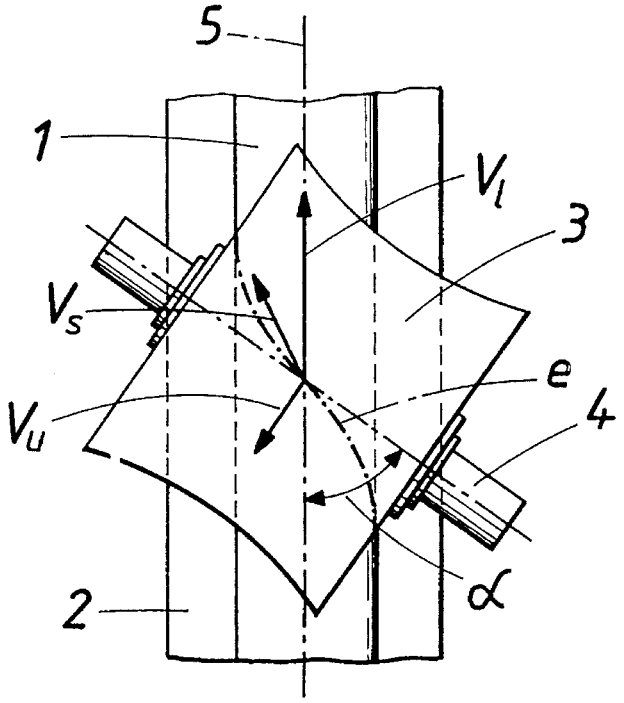
FIG. 2 is a top plan view showing the abrasive product of FIG. 1.
Figure 3:
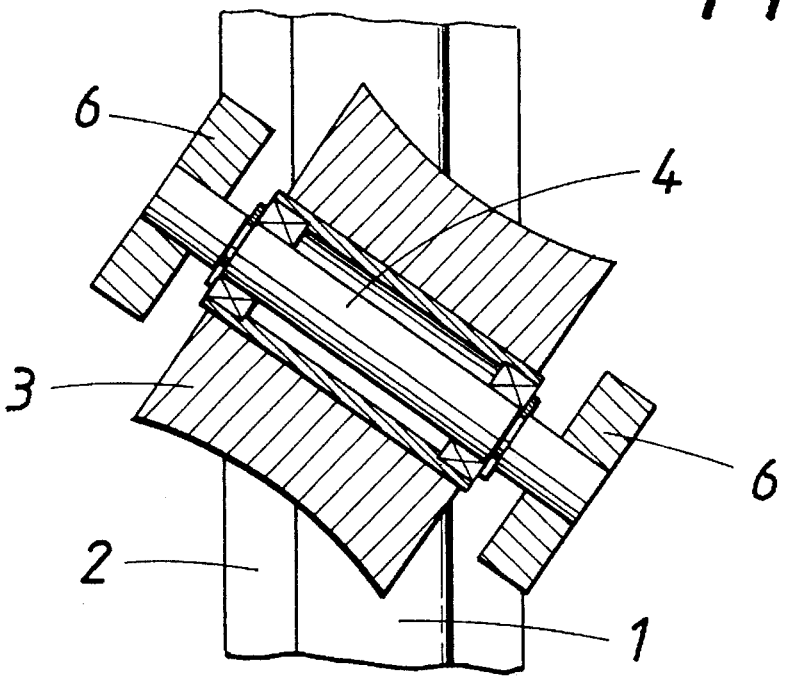
FIG. 3 is a sectional view taken on lone III—III in FIG. 1.

As is shown in FIGS. 1 and 2 the top surface 1 of a rail 2 is machined by means of a roll-like abrasive product 3, which in accordance with FIG. 3 is freely rotatably mounted on an axle 4, which defines for the abrasive product 3 an axis of rotation, which extends in a plane that is parallel to the rail foot. The axis of the axle 4 is inclined from the longitudinal direction 5 of the rail at an acute angle $\alpha$, e.g., of 45°, as is apparent from FIG. 2. When the abrasive product 3 is forced against the top surface 1 of the rail 2 under a predetermined pressure force P and is moved at a feed rate $v_i$ in the longitudinal direction 5 of the rail, the frictional contact between the top surface 1 and the abrasive product 3 will permit two velocity components $v_u$ and $v_s$ to be derived from that feed rate $v_i$. The velocity component $v_u$ corresponds to the circumferential velocity of the abrasive product 3 rolling on the top surface 1, and the velocity component $v_s$ corresponds to the grinding velocity proper that is due to a sliding motion between the rail and the abrasive product. As a result, the top surface 1 is ground by the inclined abrasive product 3 at a grinding velocity which essentially depends on the circumferential velocity, as is clearly apparent from FIG. 2. For this reason, relatively high feed rates may be adopted because the grinding velocity is not determined by the circumferential velocity of the abrasive product, as is the case with abrasive products which are driven to rotate at a circumferential velocity which is a multiplicity of the feed rate. For this reason the pressure force P under which the abrasive product 3 is forced against the top surface 1 of the rail 2 may be selected in dependence on the compressive strength of the abrasive product 3 so that the grinding conditions are different from those obtained where driven grinding wheels are employed.

Also in FIG. 2 an S-shaped dash-dot line e represents the projections of the line of contact between the abrasive product 3 and the top surface on the paper plane, which is parallel to the rail foot. That line of contact extends from one longitudinal side of the top surface 1 along the rail 2 to the other. In that projection plane the line of contact extends on the top surface 1 along the rail 2 over a length which exceeds the distance between two consecutive crests of height deviations of the top surface 1, which typically consist of ripples or the like, which are spaced along the rail 2. Because the abrasive product 3 contacts the top surface of the rail over more than one corrugation of that top surface, the risk that such grooves may be copied by the grinding operation is highly reduced.

As is apparent from FIG. 3 the abrasive product 3 may be rotatably mounted by means of its hub on an axle 4, which is non-rotatably held in a guide yoke 6. This design will result in a compact arrangement and will facilitate also the replacement of the abrasive product 3 together with the axle 4.

Figure 4:
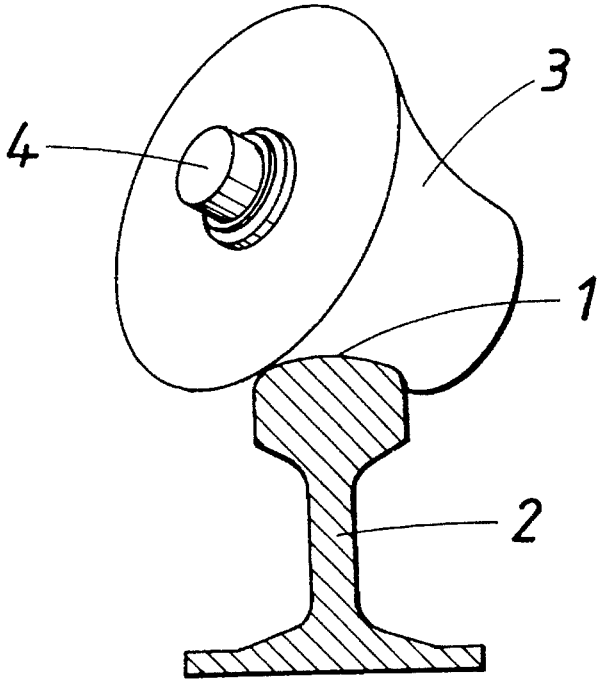
FIG. 4 is a view that is similar to FIG. 4 and shows a modification.

In general the axis of the axle 4 for the abrasive product 3 will extend in a plane that is parallel to the rail foot. But this is by no means essential. For a grinding at different grinding velocities over the width of the top surface of the rail, the axis of the axle 4 might be inclined from the plane of the rail foot, as is indicated in FIG. 4. In that case the circumferential grinding will be effected under analogous conditions.

Figure 5:
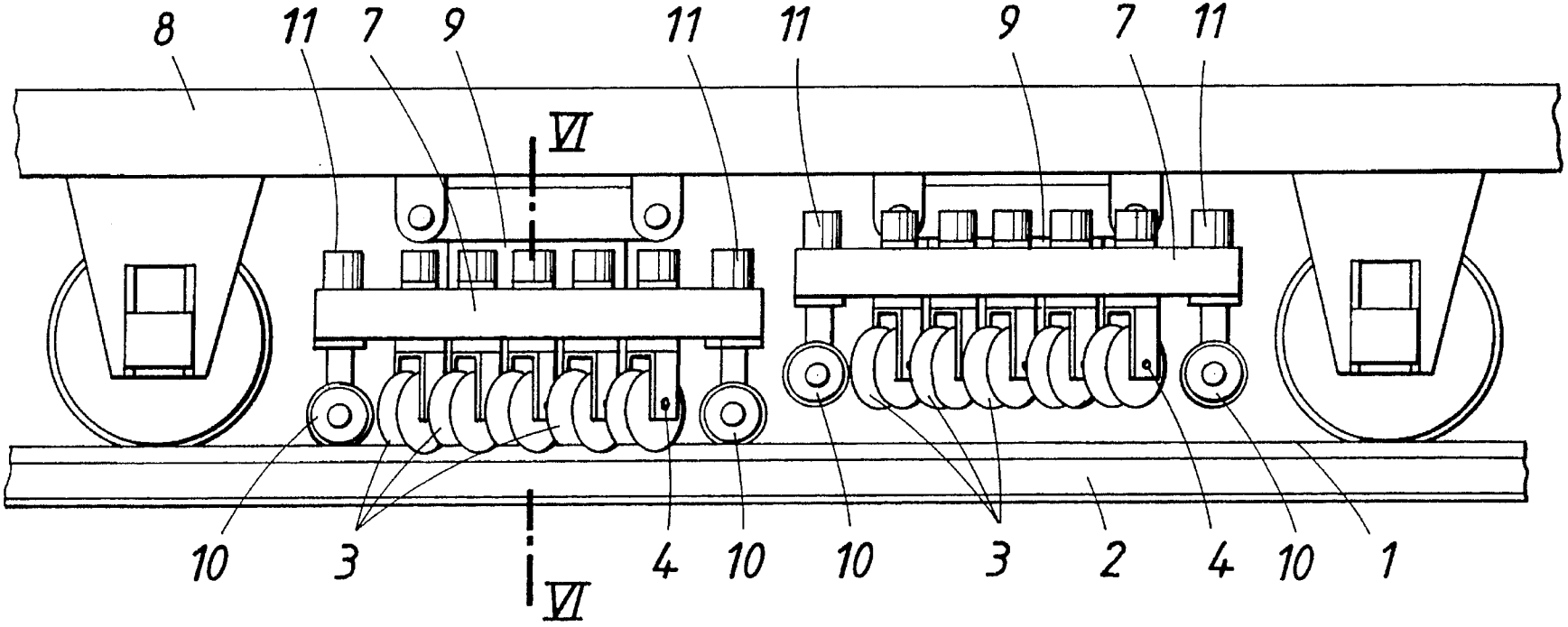
FIG. 5 is a simplified fragmentary side elevation showing on a smaller scale a rail-borne vehicle provided with two apparatuses in accordance with the invention for a circumferential grinding of the top surfaces of rails.

In practice it is usual to employ a plurality of abrasive products 3, which are arranged one behind the other in the longitudinal direction 5 of the rails and are held in a common grinding frame 7, which is attached to a rail-borne vehicle 8, as is illustrated in FIG. 5, where two grinding frames 7 are shown. By means of a lifting and lowering device 9 each of said grinding frames 7 can be lowered relative to the top surfaces of the rails 2 to a predetermined lower position and can be lifted from that lower position, in which the grinding frame 7 is supported relative to the rails 2 by guide wheels 10, with which each grinding frame is provided. By means of pressure-applying cylinders 11 mounted in each grinding frame 7 the abrasive products 3 may be forced against the top surface 1 by a predetermined constant pressure force. In accordance with FIG. 6 the abrasive products 3 are movably mounted by means of guide yokes 6, which are supported on the grinding frame 7 in the direction of the pressure force by a spring member 12 consisting, e.g., of a rubber-elastic shim. That spring member 12 effects an additional control of the pressure force adjacent to the associated abrasive product because the spring member 12 will be subjected to a higher load adjacent to the crest of a corrugation which is to be ground and the spring member 12 ill be permitted to relax adjacent to a valley. The action of the spring members 12 may selectively be suppressed in that each spring member 12 is bridged by a rigid support 13, which is non-displaceably connected by a tubular member 14 to the guide yoke 6 in which the abrasive product 3 is movably mounted. That rigid support 13 co-operates with a hydraulically operable supporting cylinder 15, which either releases the support 13 or constitutes for that support an abutment, which can be adjusted in height, and which will then prevent a vertical movement of the guide yoke 6 relative to the grinding frame 7.

Figure 6:
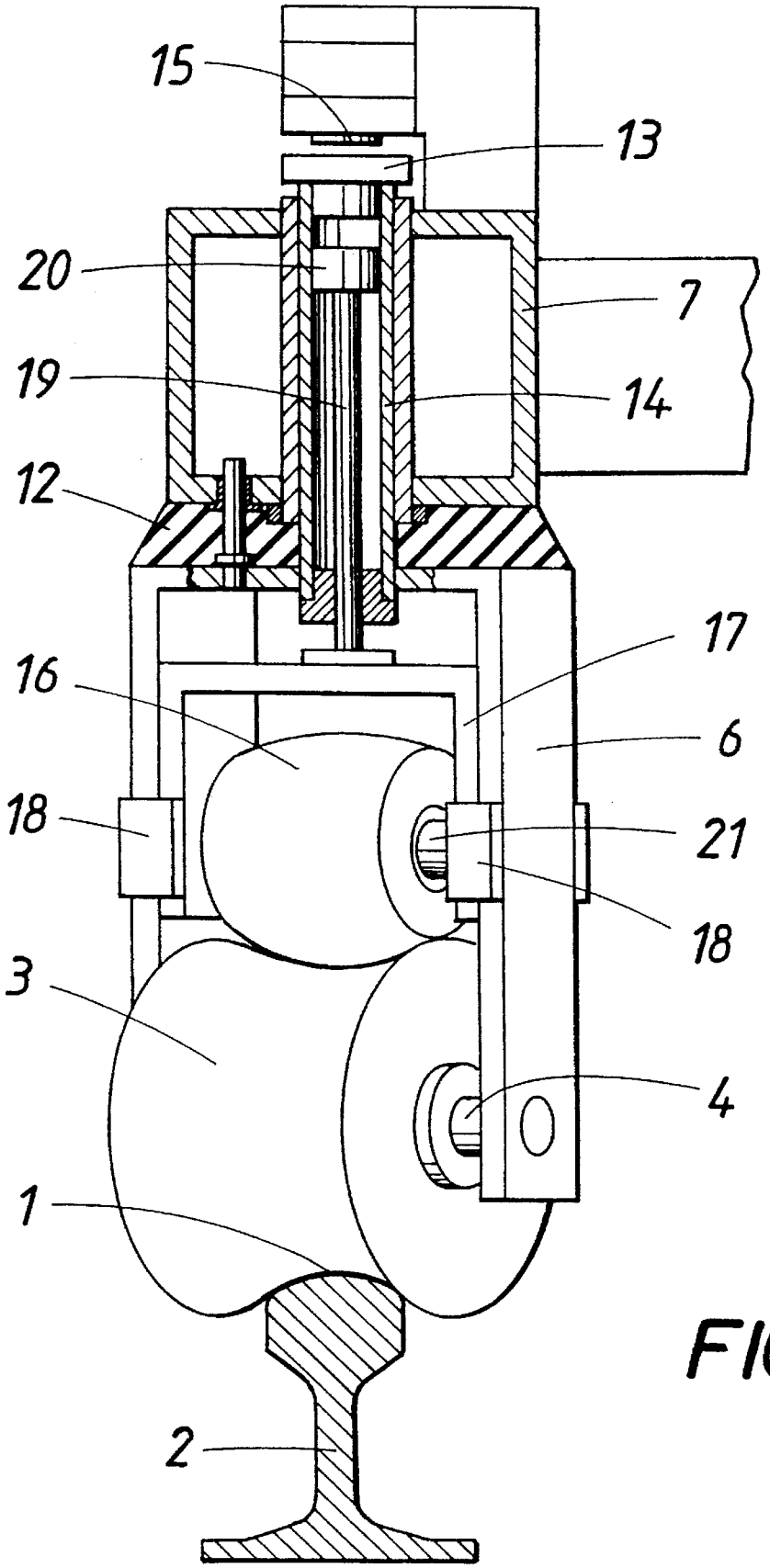
FIG. 6 is an enlarged sectional view taken on line VI—VI in FIG. 5.

Owing to the wear of the abrasive product 3, its circumferential surface will be adapted to the profile of the top surface 1 of the rail 2 after a short grinding time. To permit a grinding of the top surface 1 to a predetermined profiled shape, the abrasive product will have to be dressed accordingly. For this purpose, rotating dressing members 16 are provided, which are shown in FIG. 6 and are freely rotatably mounted in a bearing yoke 17 and by means of the bearing yoke 17 can be moved against the associated abrasive product 3 in a radial direction with respect to the abrasive product. Whereas it is more desirable for a grinding operation to rotatably mount the bearing yoke 17, a track 18 in which the bearing yoke 17 is displaceable has been shown in FIG. 6. To permit a forcing of the dressing members 16 against the associated abrasive products 3, the bearing yokes 17 are connected to a piston rod 19, which is rigid with a piston 20, which extends into the tubular member 14, which constitutes a cylinder and in which the piston is subjected to the pressure of a fluid. Because the axis of the axle 21 of the dressing member 16 crosses the axis of the axle 4 at an acute angle, the rotating abrasive product 3 will impart a rotation to the dressing member 16, which is freely rotatably mounted and forced against the abrasive product 3, and the parts 3 and 16 will perform also a sliding movement relative to each other at the same time so that the abrasive product 3 can be dressed whereas a motor drive for the dressing member 16 or the abrasive product 3 will not be required. It will be understood that the rotatable dressing member 16 might be replaced by a non-rotatably mounted dressing member although it will obviously have a shorter useful life.

I claim:

1. In a process of machining a top surface of a rail by a cylindrical grinding effected by means of at least one abrasive product which has a peripheral surface and is moved along said rail and is held to be rotatable about an axis of rotation that includes an acute angle with the longitudinal direction of said rail, wherein said abrasive product is rotated and its peripheral surface is forced against said top surface of said rail, the improvement residing in that said abrasive product is held to be freely rotatable about said axis of rotation and as said abrasive product is moved along said rail said peripheral surface is caused to be in frictional contact with said top surface to roll and slide on said top surface and thus to grind said top surface.

2. The improvement set forth in claim 1, wherein said abrasive product is forced against said top surface under a constant pressure.

3. The improvement set forth in claim 1, wherein a freely rotatable dressing member is forced against said peripheral surface as it rolls and slides on said top surface and said dressing member is held to be rotatable about an axis of rotation which crosses said axis of rotation of said abrasive product at an acute angle.

4. An apparatus for machining a top surface of a rail by a cylindrical grinding, comprising at least one abrasive product, which has a peripheral surface and is mounted to be rotatable about an axis of rotation and is adapted to be held in a grinding position, in which said axis of rotation includes an acute angle with the longitudinal direction of said rail, and pressure-applying means for forcing said peripheral surface against said top surface when said abrasive product is in said grinding position, the improvement residing in that said abrasive product is mounted to be freely rotatable about said axis of rotation, and said pressure-applying means are operable to hold said peripheral surface in frictional contact with said top surface so that when said abrasive product is moved along said rail and said peripheral surface is in said grinding position in frictional contact with said top surface said peripheral surface will be adapted to roll and slide on said top surface and thus to grind said top surface.

5. The improvement set forth in claim 4, wherein said at least one abrasive product is freely rotatably mounted in a grinding frame, which is movable along said rail and is provided with means for lowering said grinding frame relative to said top surface to a predetermined lower position and for lifting said grinding frame from said lower position, and with said pressure-applying means, which are operable to force said peripheral surface against said top surface in a predetermined direction, when said grinding frame is in said lower position, a spring member is mounted in said grinding frame and arranged to support said abrasive product in said grinding frame in said predetermined direction, and a rigid support for selectively bridging said spring member is mounted in said grinding frame.

6. The improvement set forth in claim 4, wherein a guide yoke is mounted in said grinding frame, an axle defining said axis of rotation is held in said guide yoke, and said abrasive product has a hub, which is mounted on said axle to be rotatable about said axis of rotation.

7. The improvement set forth in claim 6, wherein said peripheral surface is adapted to be forced against said top surface on one side of said abrasive product, a dressing member is mounted in said guide yoke to be radially displaceable relative to said abrasive product on that side thereof which is opposite to said one side, and means are provided for forcing said dressing member against said peripheral surface on said opposite side of said abrasive product.

8. The improvement set forth in claim 7, wherein a bearing yoke is mounted in said grinding frame to be radially displaceable relative to said guide yoke with respect to said abrasive product, and said dressing member is mounted in said bearing yoke to be freely rotatable about a second axis of rotation, which crosses said axis of rotation of said abrasive product at an acute angle.

* * * * *